US009248325B2

(12) United States Patent
Lewis

(10) Patent No.: US 9,248,325 B2
(45) Date of Patent: Feb. 2, 2016

(54) ASSIST UNIT FOR LARGE OUTDOOR FIRES

(71) Applicant: Nathanial Henry Lewis, Fallon, NV (US)

(72) Inventor: Nathanial Henry Lewis, Fallon, NV (US)

( * ) Notice: Subject to any disclaimer, the term of this patent is extended or adjusted under 35 U.S.C. 154(b) by 478 days.

(21) Appl. No.: 13/815,257

(22) Filed: Feb. 15, 2013

(65) Prior Publication Data

US 2014/0231106 A1 Aug. 21, 2014

(51) Int. Cl.
*A62C 3/02* (2006.01)
*A62C 31/28* (2006.01)

(52) U.S. Cl.
CPC ..... *A62C 3/0207* (2013.01); *A62C 31/28* (2013.01)

(58) Field of Classification Search
CPC ..... A62C 3/0207; A62C 31/28
See application file for complete search history.

(56) References Cited

U.S. PATENT DOCUMENTS

| | | | | | |
|---|---|---|---|---|---|
| 2,884,075 | A | * | 4/1959 | Poon | 169/48 |
| 3,724,554 | A | * | 4/1973 | Rupert et al. | 169/52 |
| 4,805,702 | A | * | 2/1989 | White | 169/64 |
| 4,886,233 | A | * | 12/1989 | Bateman et al. | 248/647 |
| 5,256,039 | A | * | 10/1993 | Crawford | 417/234 |
| 5,941,314 | A | * | 8/1999 | Weinmeister et al. | 169/52 |
| 6,786,286 | B1 | | 9/2004 | Bartlett | |
| 8,002,200 | B2 | | 8/2011 | Joseph et al. | |

* cited by examiner

*Primary Examiner* — Ryan Reis

(57) ABSTRACT

The invention is designed to be used for the large outdoor fires such as fires on the U.S. Navy's aircraft carriers, in forests and grasslands and at airports and chemical plants. The operators of an "assist unit" should always be behind the firefighters. At long range it can blow fire suppressors into a fire and smother it. The suppressors can be water or chemicals by the firefighters. Soot, ashes, dirt or sand around a fire itself are good suppressors. The "assist unit" will blow them into the fire and it blows away the smoke and fumes as well. There are two versions of the "assist unit": the ALL MANUAL one and the VEHICLE MOUNTED one.

4 Claims, 6 Drawing Sheets

ASSIST UNIT FOR LARGE OUTDOOR FIRES

BACKGROUND OF THE INVENTION

1. Field of the Invention

The present invention relates to the field of firefighting. Specifically, it relates to a unit that can assist in combating large dangerous outdoor fires effectively. The unit is very easy to use.

2. Description of the Related Art

Any discussion of the prior art throughout the specification should in no way be considered as an admission that such prior art is widely known or forms part of common general knowledge in the field.

For years firefighters have used ventilation fans of various types, designs and sizes. They are good for small and large structure fires. They are not designed to combat the large dangerous outdoor fires such as fires on the U.S. Navy's aircraft carriers, in forests and grasslands and at airports and chemical plants.

BRIEF SUMMARY OF THE INVENTION

There are two versions of this "assist unit": the ALL MANUAL one and the VEHICLE MOUNTED one. The following information applies basically to both versions of the "assist unit."

Firefighters can fight large outdoor fires with a vengeance safely and efficiently; they insist on efficiency and simplicity in their equipments. The unit is relatively simple and economical. At long range it can blow fire suppressors into the fire and smother it.

The suppressors can be water or chemicals used by the firefighters. Soot, ashes, dirt or sand around a fire itself are good suppressors; the "assist unit" will blow them into the fire.

The unit blows away the smoke as well so the firefighters can see where the fire is located. This makes it possible for them to move in closer and see more clearly, having less fumes and smoke to hinder them. The operators of the unit remain safe at all times and behind the firefighters.

In cases of forest or grassland fires, besides the water and chemicals, dirt and soot are blown into the fire as well. In cases of aircraft, chemical plant or oil tanker fires the chemical fire suppressor used is blown over the fire like a smoldering blanket.

The following information applies to the ALL MANUAL version only. The wheels should be relatively large in diameter for easy moving over rough terrain. The tires should not be pneumatic ones, to make the unit more durable and reliable; hard rubber would be one type of material to use. The unit can be moved and given the best position behind the firefighters quickly.

However, the VEHICLE MOUNTED version will be able to get to remote grassland and forest areas faster. It will have the elevation to make it very effective in fighting fires in these areas. It has the potential to save homes and other structures in these areas.

BRIEF DESCRIPTION OF THE DRAWINGS

The drawings will show the advantages and objects of this invention.

DETAIL DESCRIPTION

Both firefighters and non-firefighters are aware of the danger of large fires, indoor or outdoor. Tactics and operations planning in fighting large outdoor fires closely imitate operations used by the U.S. Military.

Figure 1:
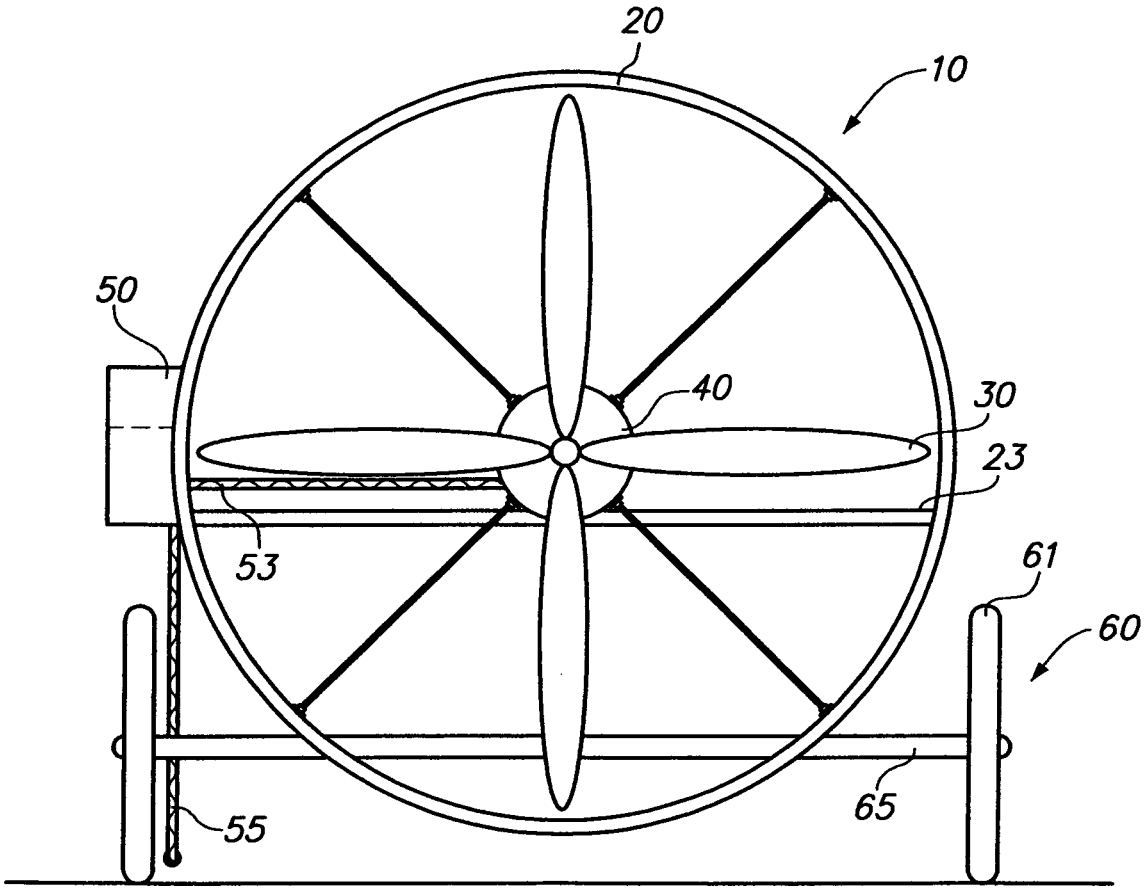
FIG. 1 is a front view of the ALL MANUAL version of the "assist unit"

In FIG. 1 the "assist unit" is an ALL MANUAL version. An air unit 10 comprising a relatively large circular housing 20 with several vanes 30 and an electric motor 40 mounted inside. The vanes 30 are attached to the motor's shaft. An electric control box 50 is mounted on the housing 20. The housing 20 is mounted on two rear wheels 60 and their axle 65. A front wheel assembly 70, not shown, was omitted for clarity. There should be a safety screen; it will be omitted in all drawings.

There is a bar 23 for pushing the "assist unit". The bar 23 is cylindrical in shape and stretches across the rear of the housing 20; each end is fastened to a side of the housing 20. There is an electric cable (cord) 53 to the motor 40 from the control box 50 and one 55 to an electric power supply.

The optimum size would be 8 feet for the inner diameter of the housing 20. The housing 20 should be 9 to 11 inches above ground level. A powerful electric motor 40 and its relatively large efficient vanes 30 should generate a large rapid flow of air through the housing 20. The housing 20 can direct the airflow to the base of the fire, its most intense area. The circular housing 20 can be tapered at its front end to increase the speed of its airflow. The housing 20 depth should be substantial or at least 2 feet. The wheels 60 should have a diameter of 3 to 4 feet to allow for fast and easy moving of the "assist unit." The electric cable 55 should be 100 feet. This keeps the electric power supply at a safe distance from the fire but still within a reliable range.

Figure 2:
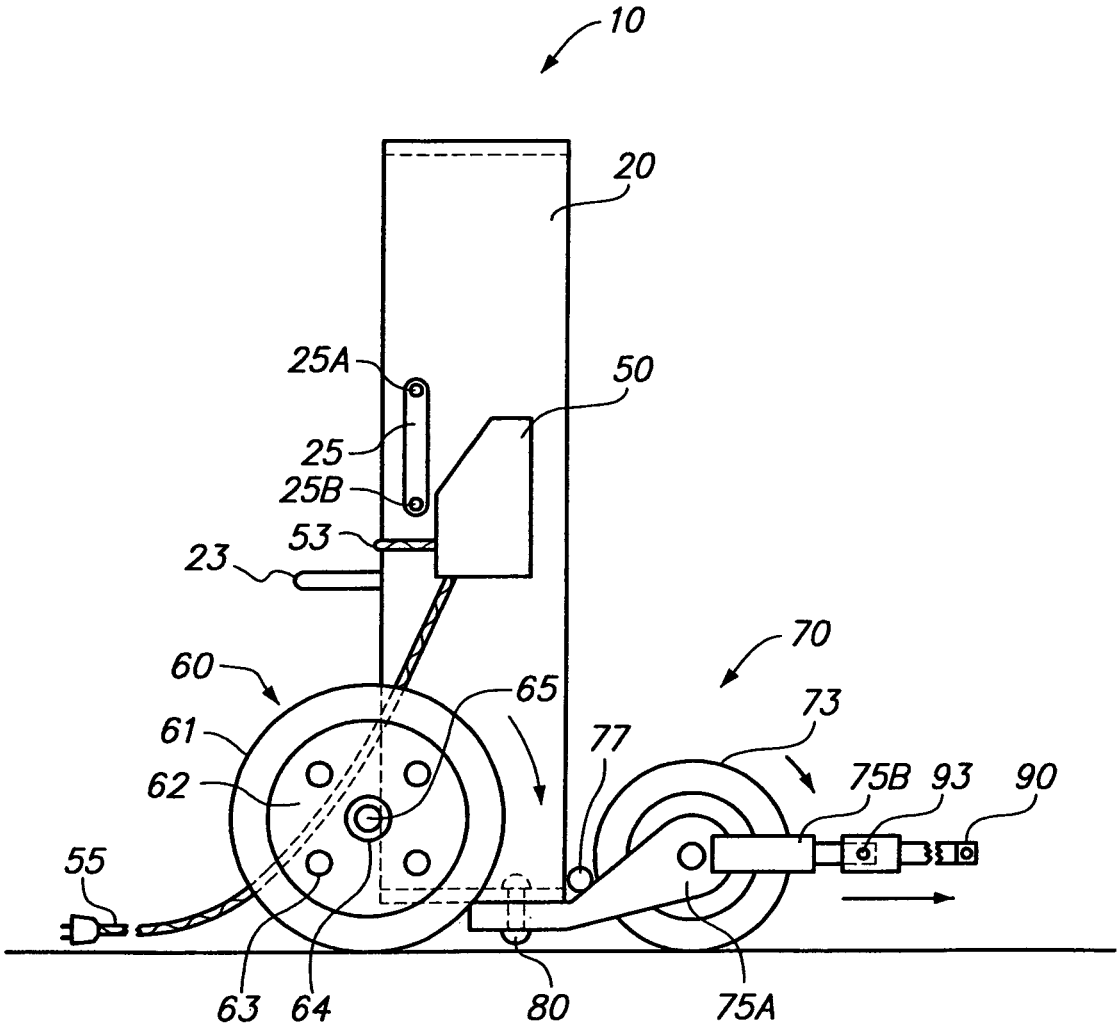
FIG. 2 is a side view of FIG. 1.

In FIG. 2 a plate 25 with protruding cylindrical hangars 25A and 25B for securing the electric cable 55 when it is not in use. Each wheel 60 should have a non-pneumatic tire 61 around its rim to make the "assist unit" more durable and reliable; hard rubber would be one type of material to use. The rear tires 61 should be fairly wide and lightweight to offset any sinking in soft surfaces.

Each wheel 60 has a central portion with 4 holes 63 and a hub 64. A strong cable that can be fastened at its ends can be used to prevent the "assist unit" from moving when the air unit 10 is turned on. One end of the cable is passed through a hole 63, around the axle 65 and the two ends are fastened together. A wheel with spokes can be used as well.

The front wheel assembly 70 comprises a rear structure 75A fastened to a front structure 75B. One is supporting a wheel 73 and its axle. The wheel 73 should have a non-pneumatic tire. There is a lifting ring 77 at the base of the rear structure 75A. The two structures 75A and 75B could possibly be made as one structure. The assembly 70 can be fastened to the bottom of the housing 20 by a means for fastening 80. The means for fastening 80 should secure the assembly 70 to the housing 20 well but still allow movement between them. One means 80 can be a large rivet. A removable tow bar 90 and its pin 93 can be mounted on the front of the assembly 70.

The "assist unit" can be carried to a fire by a helicopter. Lifting cables can be placed around the axle 65 and through the lifting ring 77. The tow bar 90 can be tied to the housing 20. The portable electric power supply can be air lifted by another helicopter. The "assist unit" and its portable electric power supply can be carried on a flatbed truck or towed in a trailer to a fire. At the fire the "assist unit" can be towed manually by its tow bar 90.

Figure 3:
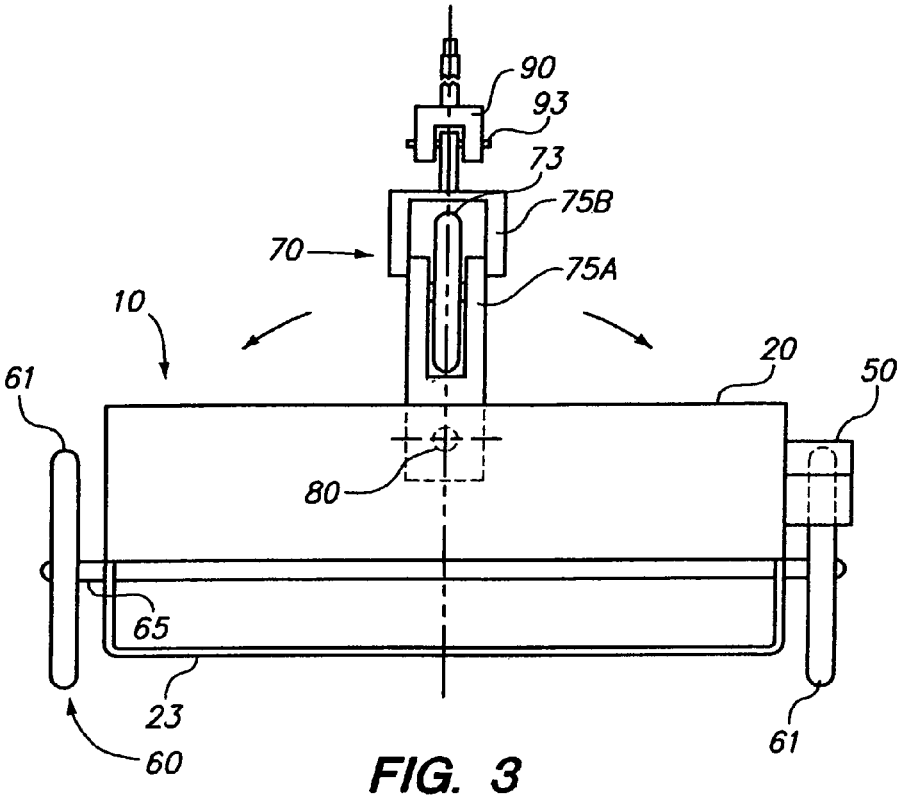
FIG. 3 is a top view of FIG. 2.

FIG. 3 gives another view of many of the above constructional parts. The plate 25, the two electric cables 53 and 55 and the lifting ring 77 are omitted for clarity.

Figure 4:
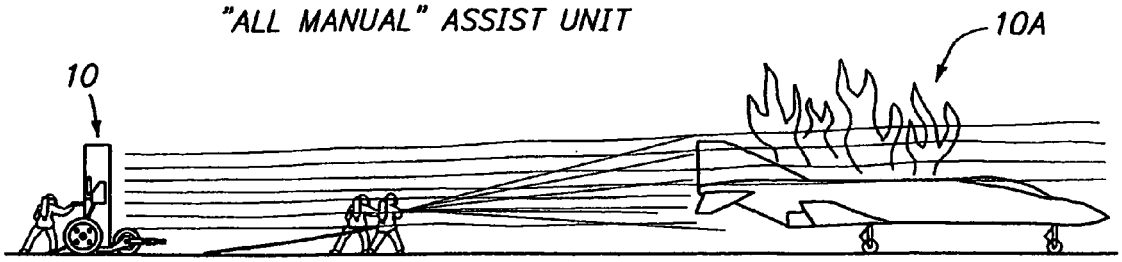
FIG. 4 is a side view of this version in operation.

FIG. 4 gives an operational view of a large outdoor fire 10A; firefighters are being assisted with an "assist unit." They can get to the heart of the fire with the air unit 10.

Figure 5:
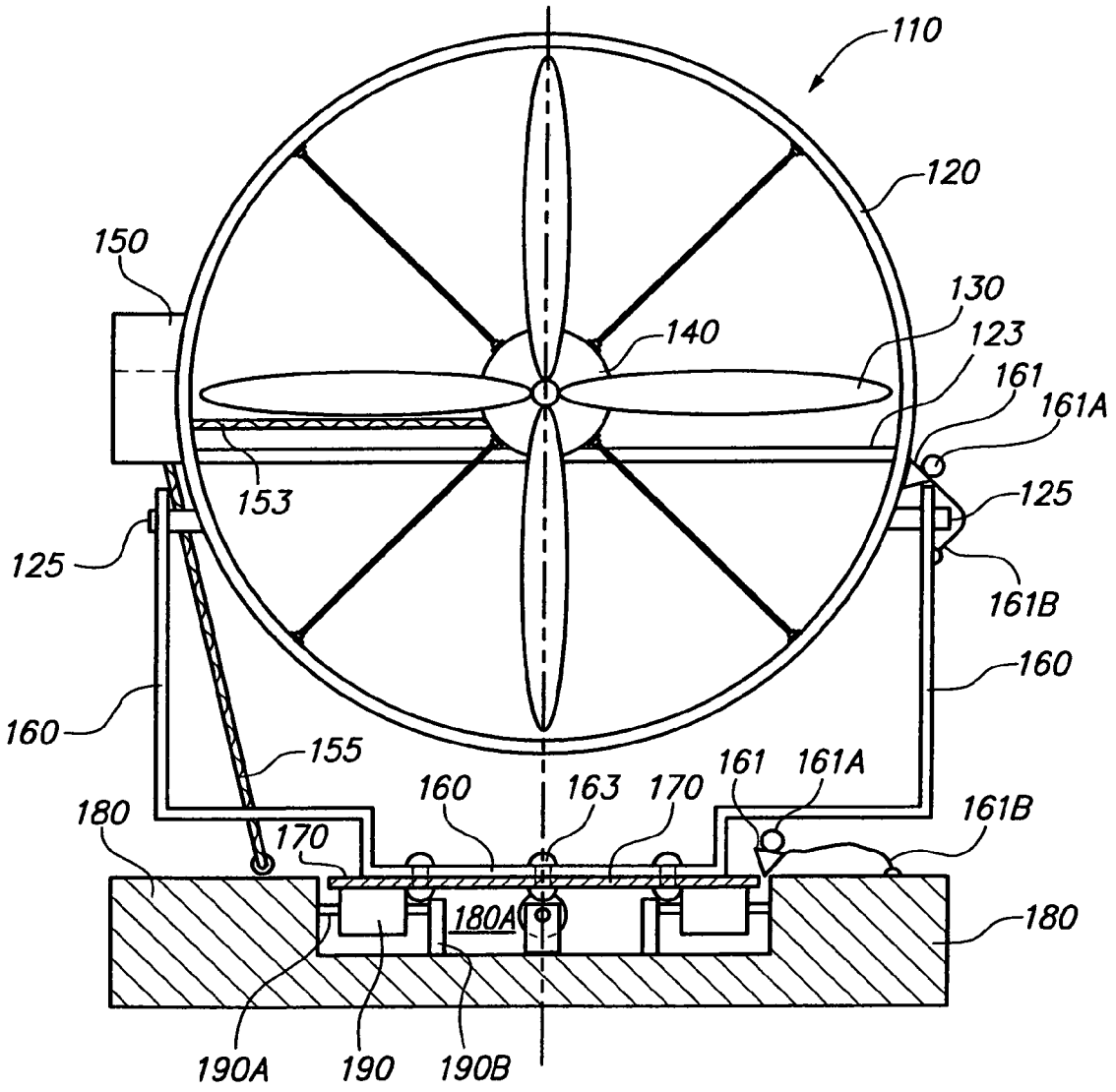
FIG. 5 is a front view of the VEHICLE MOUNTED version of the assist unit.

In FIG. 5 the "assist unit" is a VEHICLE MOUNTED version. An air unit 110 comprises a relatively large circular housing 120 with several vanes 130 and an electric motor 140 mounted inside. The vanes 130 are attached to the motor's shaft. An electric control box 150 is mounted on the housing 120. The housing 120 is mounted onto a vertical structure 160 by its axle 125. This axle 125 is in two parts, one on each side of the housing 120 and in alignment with each other. The axle 125 can be one unit from one side to the other. The base of the vertical structure 160 is secured to a circular rotary plate 170 by means for fastening 163; several methods can be used. In this case rivets 163 were used.

The rotary plate 170 and stationary base 180 are shown section. The plate 170 is mounted on four rollers 190. Each roller 190 has an axle, one end, 190A, is inserted into the stationary base 180 and the other end is inserted into a rectangular support 190B. The rollers 190 are 90 degrees apart inside a circular hollow compartment 180A in the stationary base 180. The rollers 190 are free to roll in their stationary positions. The rollers 190 can be cylinder-shaped or sphere-shaped.

There is a bar 123 for angling or rotating the housing 120. The bar 123 is cylindrical in shape and stretches across the rear of the housing 120. Each end is fastened to a side of the housing 120. There is an electric cable 153 to the motor 140 from the control box 150 and another cable 155 can be to the electric power system of the vehicle it is mounted on. The unit's electric power supply can be separate from the vehicle's power system.

The optimum size would be 8 feet for the inner diameter of the housing 120. The housing 120 should have a depth of at least 2 feet. A powerful electric motor 140 and its large efficient vanes 130 should generate a large rapid flow of air through the housing 120. The housing 120 can direct the airflow to the base of the fire, its most intense area.

The vertical structure 160 is both the housing 120 holding and motion section. The housing 120 can be angle-up to some angles above the center line, or angle-down. A malleable but tough upper wedging device 161 can be used to stop the housing 120 at some desired angle. A second lower wedging device 161 can be used to stop the rotary plate 170 at some desired position. There will be a ring 161A for inserting and removing each device 161 and a small cord 161B for holding each device 161. The two devices 161 work by frictional forces to stop the housing 120 from vertical motion and the plate 170 from rotary motion. There should be a safety screen.

Figure 6:
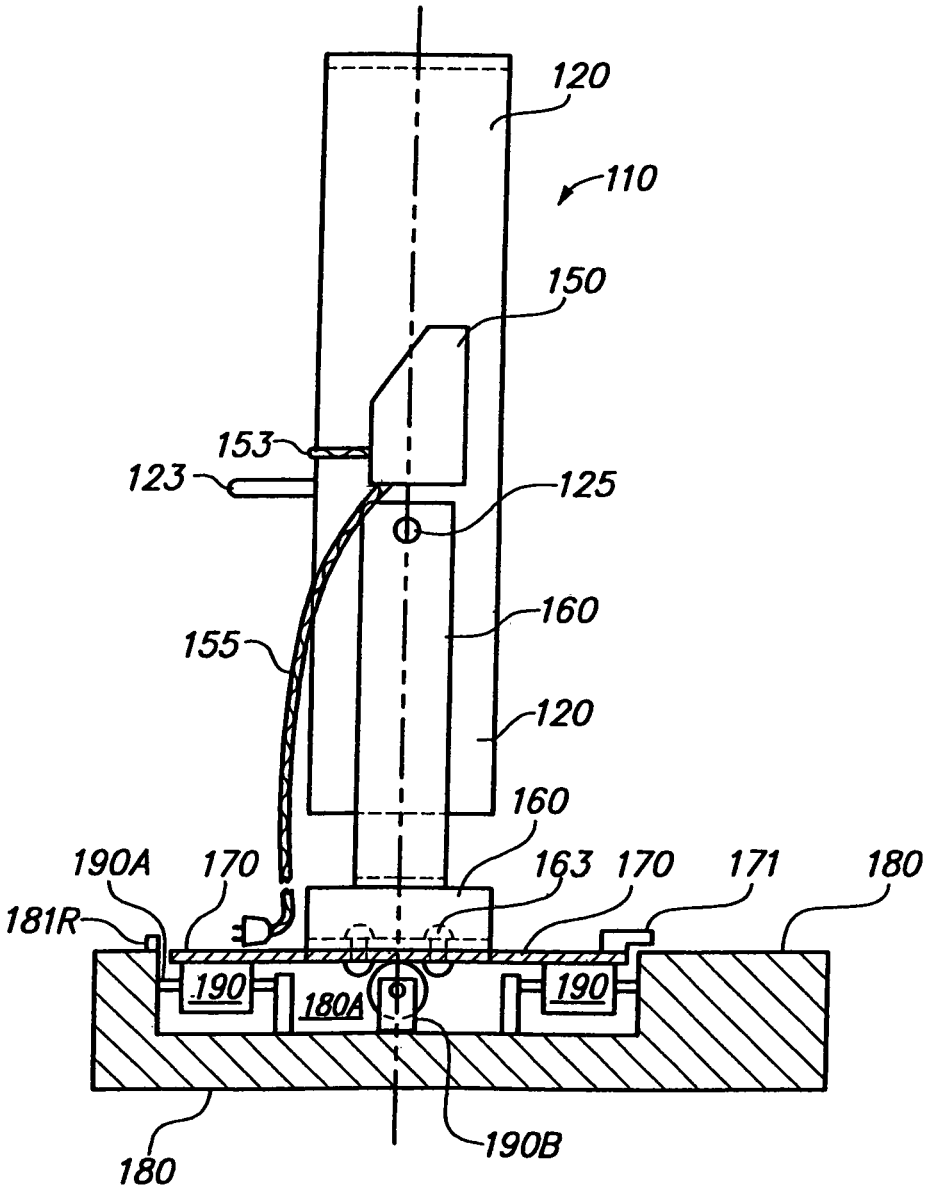
FIG. 6 is a side view of FIG. 5.

In FIG. 6 the wedging devices 161 are omitted for clarity. However, it gives another view of many of the above constructional parts. A stop bar 171 is shown mounted on the rotary plate 170. One 181R of the two stop posts is shown. Both will be shown in FIG. 7.

Figure 7:
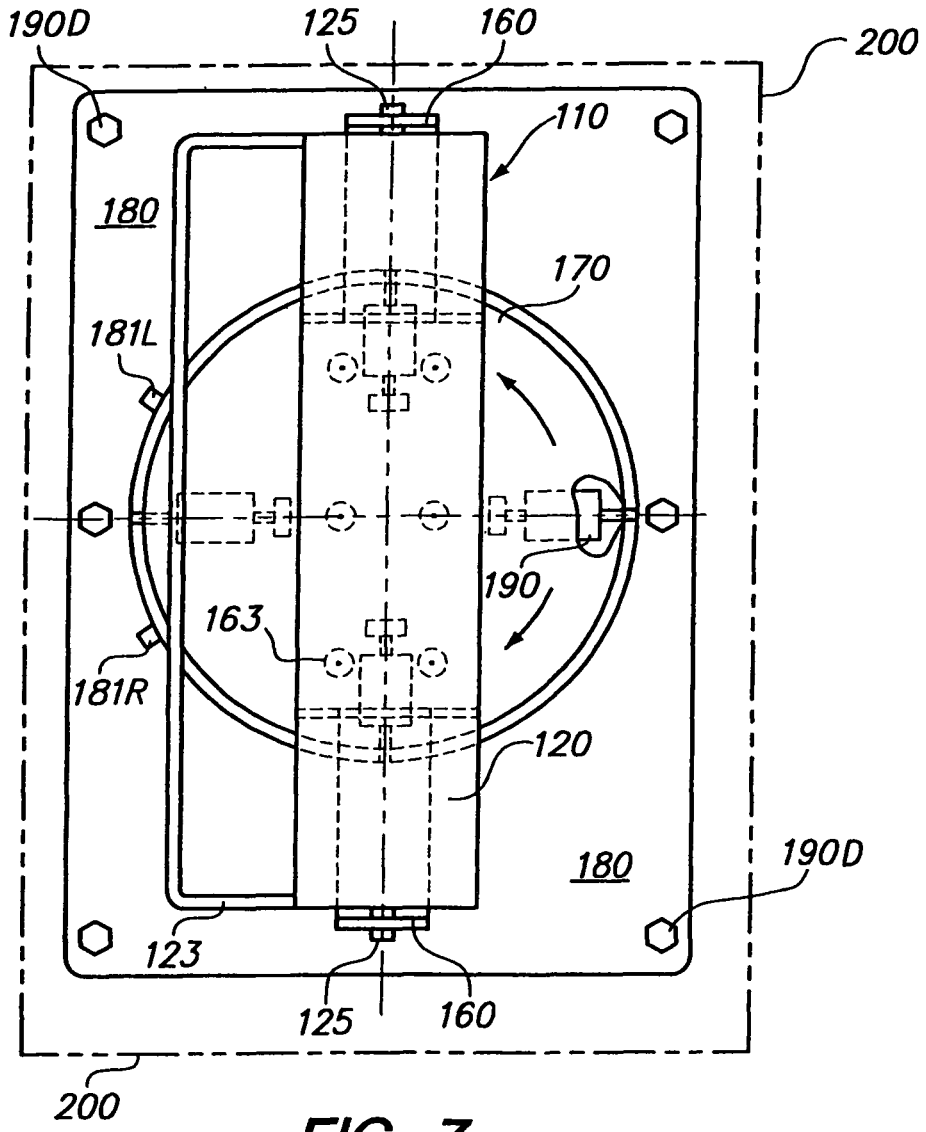
FIG. 7 is a top view of FIG. 6.

In FIG. 7 the electric control box 150, the two electric cables 153 and 155 and the wedging devices 161 are omitted for clarity. However, it gives another view of many of the above constructional parts. The stationary base 180 is mounted on a vehicle 200 by means of fastening 190D such as bolting, riveting or welding. Six bolts 190D are shown.

There should be right and left stop posts 181R and 181L mounted on the base 180. The rotation of the rotary plate 170 should be 150 degrees to the right and 150 degrees to the left. The stop bar 171 shown in FIG. 6 will do the stopping in both cases; bar 171 is not shown in FIG. 7. The rotary plate 170 will have a total rotation of 300 degrees. This would prevent the electric cable 155 from being damaged.

Figure 8:
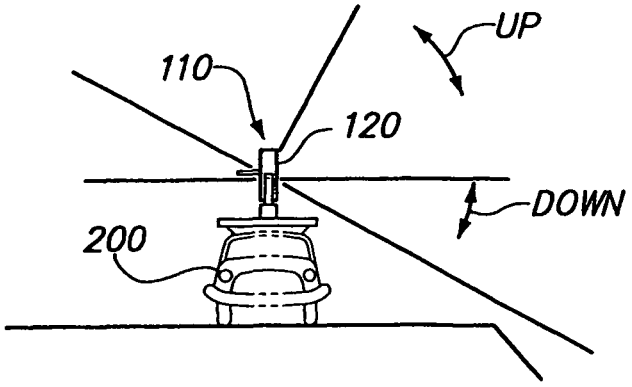
FIG. 8 is a side view of this version in operation.

In FIG. 8 the housing 120 can be tilted up to some angle or tilted down to some angle. This gives great advantage to the air unit 110 mounted on the vehicle 200. Several parts of the two air units 10 and 110 are interchangeable.

Using a bulldozer to create a firebreak is one of firefighters' most successful tactics. An "assist unit" behind a bulldozer together could push the fire back much farther than now. There would be more comfort and safety for the person on the bulldozer as well.

The ALL MANUAL version would require one person handling the portable electric power supply and two persons handling the "assist unit." The VEHICLE MOUNTED version would require a minimum of two persons, a driver and a unit operator. In the future the firefighters may be humanoid robots.

The advantages and objects are shown in the drawings, explained in the descriptions and summarized below. They apply to both versions.

1. The effectiveness of the "assist unit" is due to:
   a) The optimum physical size of the air unit, that it's not too big, heavy or clumsy, and not too small and inefficient and,
   b) The arrangement of parts. This gives it the ability to move large volumes of air fast in a focused direction.
2. The "assist unit's" other inherent qualities are due to the relatively few moving parts and common ones:
   a) They create durability and reliability and,
   b) Economically no new technology is required for its design and manufacture.

I claim:

1. A firefighting assist unit of the all manual version having an air unit mounted on wheels with non-pneumatic tires, and comprising:
   a) a circular housing with a depth, an electric motor is mounted inside said circular housing;
   b) a push bar stretches across the rear of said circular housing, each end of said bar is fastened to a side of said circular housing;
   c) said circular housing is mounted on two rear wheels and their axle;
   d) said circular housing is mounted on a front wheel assembly comprising a rear structure fastened to a front structure, said rear structure supports a wheel and its axle, and a means for fastening will secure said front wheel assembly to the bottom of said circular housing at said rear structure;
   e) a tow bar is mounted on the front of said front wheel assembly at said front structure;
   f) an electric control box is mounted on said circular housing, there is an electric cable to said electric motor from said control box, and there is another electric cable to an electric power supply from said control box, and
   g) whereby movement of said assist unit can be made with said tow bar.

2. A firefighting assist unit of the vehicle mounted version having an air unit that is elevated, and mounted to a vertical structure which is mounted on a rotary plate and comprising:

a) a circular housing with a depth, an electric motor is mounted inside said circular housing;

b) a push bar stretches across the rear of said circular housing, each end of said bar is fastened to a side of said circular housing;

c) said circular housing is mounted onto a vertical structure by its axle, said axle is from one side to the other side of said circular housing;

d) said vertical structure has a base that is secured to a circular rotary plate by a means for fastening;

e) said circular rotary plate is mounted on cylinder-shaped rollers, said rollers are apart inside a circular hollow compartment in a stationary base;

f) each said roller has an axle, one end of said axle is inserted into said stationary base and the other end of said axle is inserted into rectangular support;

g) an electric control box is mounted on said circular housing, there is an electric cable to said electric motor from said control box, and there is an electric cable to an electric power supply from said control box, and h) whereby said rollers inside said circular hollow compartment in said stationary base, said rollers are free to roll in their stationary positions.

3. The firefighting assist unit of the vehicle mounted version as claimed in claim 2, wherein said means for fastening further comprising rivets.

4. The firefighting assist unit of the vehicle mounted version as claimed in claim 2, wherein said rollers further comprising four rollers at 90 degrees apart inside said circular hollow compartment.

* * * * *